US006979952B2

(12) United States Patent
Choi et al.

(10) Patent No.: US 6,979,952 B2
(45) Date of Patent: Dec. 27, 2005

(54) ELECTRODELESS LAMP SYSTEM WITH ORTHOGONALLY DISPOSED RESONANCE UNITS

(75) Inventors: Joon-Sik Choi, Seoul (KR); Yong-Seog Jeon, Gyeonggi-Do (KR); Hyo-Sik Jeon, Gyeonggi-Do (KR); Hyun-Jung Kim, Seoul (KR); Ji-Young Lee, Gyeonggi-Do (KR); Byeong-Ju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 62 days.

(21) Appl. No.: 10/609,620

(22) Filed: Jul. 1, 2003

(65) Prior Publication Data

US 2004/0178735 A1 Sep. 16, 2004

(30) Foreign Application Priority Data

Mar. 11, 2003 (KR) ..... 10-2003-0015204

(51) Int. Cl.[7] ..... H01J 65/04
(52) U.S. Cl. ..... 315/39; 315/248
(58) Field of Search ..... 315/39, 248

(56) References Cited

U.S. PATENT DOCUMENTS 5,838,108 A * 11/1998 Frank et al. ..... 315/39
5,990,624 A * 11/1999 Maya ..... 315/39
6,046,545 A 4/2000 Horiuchi et al. ..... 315/39
6,049,170 A * 4/2000 Hochi et al. ..... 315/39

* cited by examiner

*Primary Examiner*—Benny T. Lee
(74) *Attorney, Agent, or Firm*—Birch, Stewart, Kolasch & Birch, LLP

(57) ABSTRACT

In an electrodeless lamp system, an electrodeless lamp system in accordance with the present invention includes an electromagnetic wave generating unit for generating electromagnetic wave; a resonance unit connected to the electromagnetic wave generating unit for resonating the electromagnetic wave generated in the electromagnetic wave generating unit in a certain frequency; and a luminous unit connected to the resonance unit in order to generate light by forming plasma by an electric filed formed in the resonance unit; wherein the resonance unit includes a first resonance unit connected to the electromagnetic wave generating unit and a second resonance unit vertically connected to the first resonance unit, connected to the luminous unit and forming a resonance space for resonating in a certain frequency with the first resonance unit.

32 Claims, 11 Drawing Sheets

ELECTRODELESS LAMP SYSTEM WITH ORTHOGONALLY DISPOSED RESONANCE UNITS

BACKGROUND OF THE INVENTION

1. Field of the Invention

The present invention relates to an electrodeless lamp system.

2. Description of the Related Art

In general, an electrodeless lamp system emits light continually by making luminous material filled in a bulb converted into a plasma state by using electric field formed by electromagnetic wave generated by an electromagnetic wave generator (magnetron, etc) used for a microwave oven, etc.

Because one electrodeless lamp system can have luminous flux corresponding to that of the several conventional lighting apparatus, it is used for places requiring intensive lighting such as a football field, a baseball field and a road (as a street light), and fields of application thereof have been diversified.

However, the electrodeless lamp system requires an additional unit such as a cooling unit, etc. in order to discharge heat generated in the operational process thereof, and a performance and life-span of the electrodeless lamp system is greatly influenced by a structure thereof.

Accordingly, a structure capable of having long life-span and performing stable operation is required for the electrodeless lamp system. In addition, it is also possible to use the electrodeless lamp system for a point light source or a projector, etc. by having more appropriate structure.

SUMMARY OF THE INVENTION

In order to satisfy the above-mentioned needs, it is an object of the present invention to provide an electrodeless lamp system capable of having an improved performance and a compact construction by having vertically combined two resonance units for forming an electric field.

In order to achieve the above-mentioned object, an electrodeless lamp system in accordance with the present invention includes an electromagnetic wave generating unit for generating electromagnetic wave; a resonance unit connected to the electromagnetic wave generating unit for resonating the electromagnetic wave generated in the electromagnetic wave generating unit in a certain frequency; and a luminous unit connected to the resonance unit in order to generate light by forming plasma by electric field formed in the resonance unit; wherein the resonance unit includes a first resonance unit connected to the electromagnetic wave generating unit and a second resonance unit vertically connected to the first resonance unit, connected to the luminous unit and forming a resonance space for resonating in a certain frequency with the first resonance unit.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiments of the present invention will be described with reference to accompanying drawings.

Figure 1:
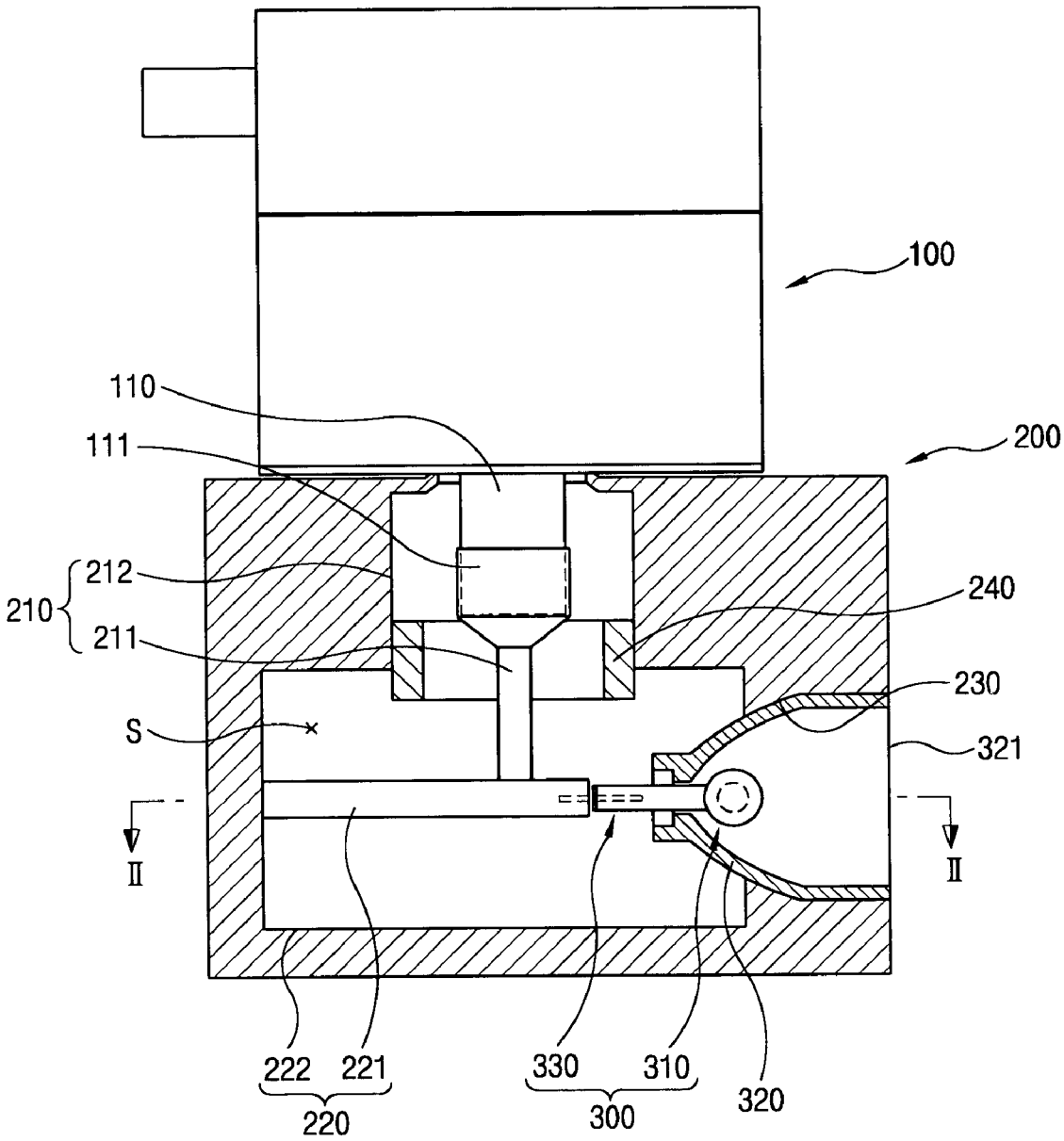
FIG. 1 is a sectional view illustrating an electrodeless lamp system in accordance with the present invention.

As depicted in FIG. 1, an electrodeless lamp system in accordance with the present invention includes an electromagnetic wave generating unit 100 for generating electromagnetic wave; a resonance unit 200 connected to the electromagnetic wave generating unit 100 in order to resonate the electromagnetic wave generated in the electromagnetic wave generating unit 100 in a certain frequency; and a luminous unit 300 connected to the resonating unit 200 and generating light by forming plasma according to electric field formed in the resonance unit 200.

The electromagnetic wave generating unit 100 is for generating electromagnetic wave as a magnetron, is connected to a power supply unit (not shown), generates electromagnetic wave according to power supply of the power supply unit, is connected to the resonance unit 200 and provides electromagnetic wave into a resonance space S.

The resonance unit 200 includes a first resonance unit 210 connected to the electromagnetic wave generating unit 100; and a second resonance unit 220 vertically connected to the first resonance unit 210, connected to the luminous unit 300 and forming the resonance space S resonated in a certain frequency with the first resonance unit 210.

As depicted in FIG. 1, the first and second resonance units 210, 220 are coaxial type waveguides constructed with concentric internal and external conductors, they respectively include an internal conductor 211, 221 and an external conductor 212, 222 having the same center with the internal conductor 211, 221.

The internal conductors 211, 221 of the first and second resonance units 210, 220 may be a rod having a specific length, they can have various sectional shapes such as circular, triangular, rectangular and polygonal shapes, etc., however, it is preferable to have a circular shape as shown in the preferred embodiments of the present invention.

The external conductors 212, 222 of the first and second resonance units 210, 220 are concentric with the center of the internal conductors 211, 221, as well as the internal conductors 211, 221, they can have various sectional shapes such as circular, triangular, rectangular and polygonal shapes, etc., however, it is preferable to have a circular shape, i.e. an annular shape.

Figure 2:
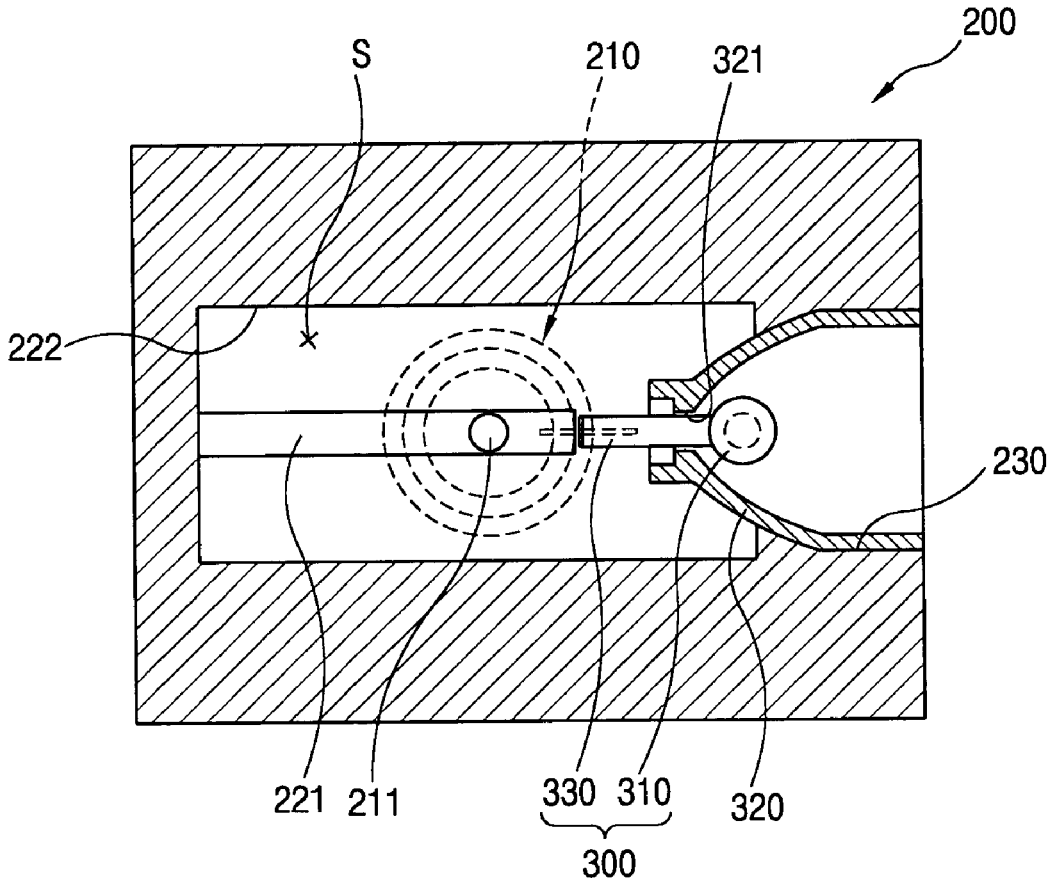
FIG. 2 is a sectional view taken along II—II direction of the electrodeless lamp system in FIG. 1.
Figure 3:
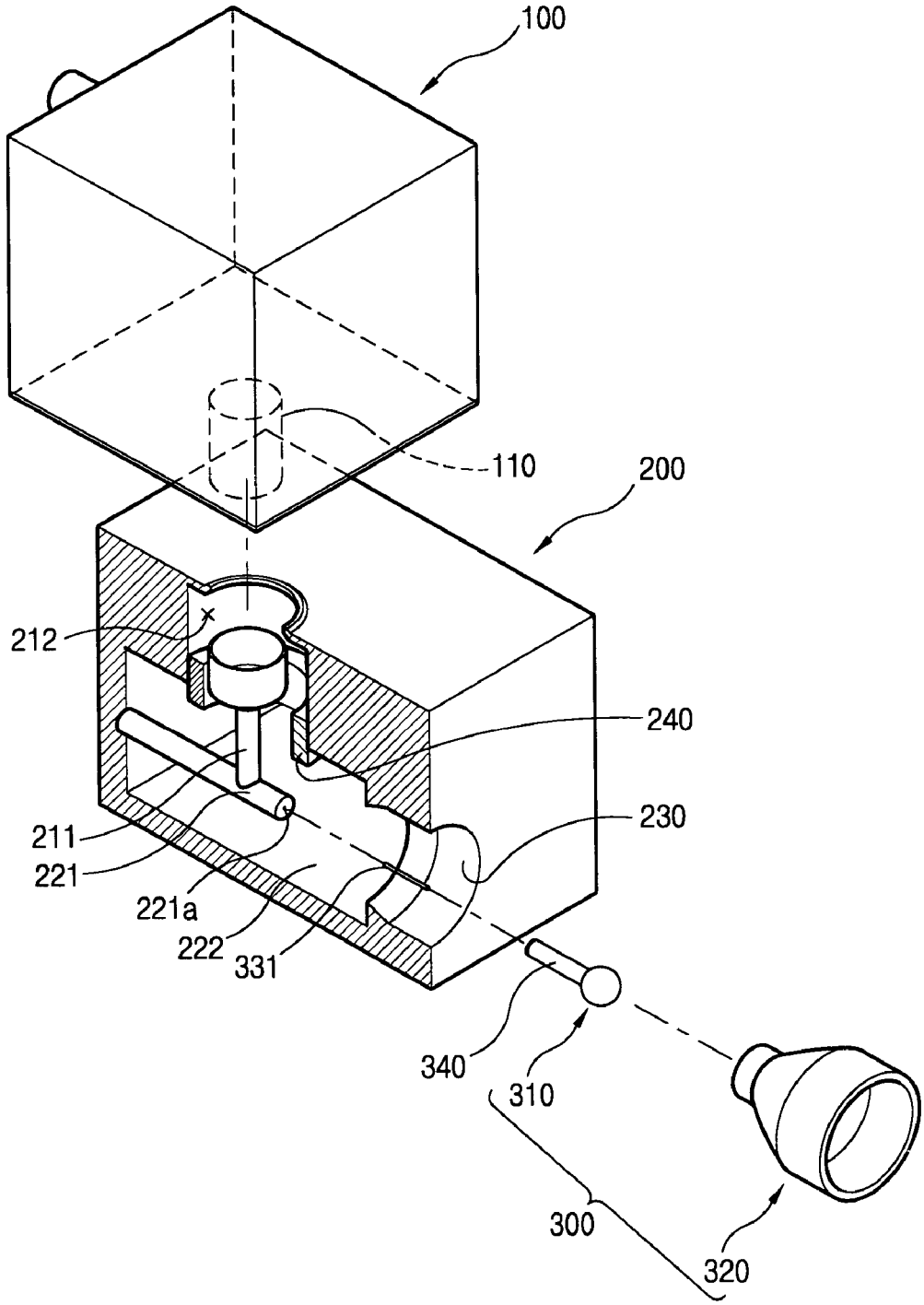
FIG. 3 is an exploded-sectional view illustrating part of the electrodeless lamp system in FIG. 1.
Figure 4:
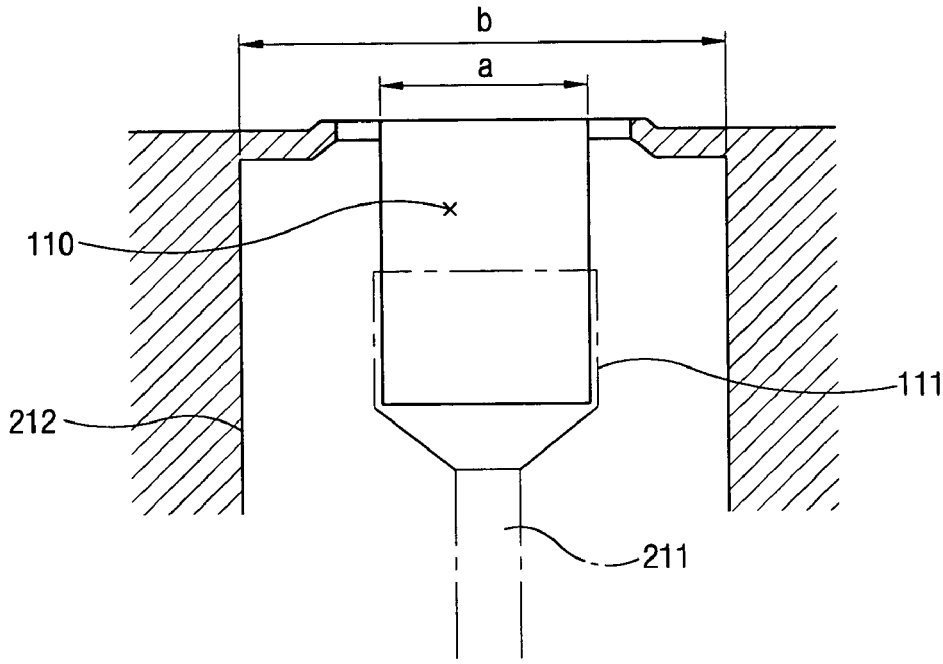
FIG. 4 is an enlarged-sectional view illustrating a connection part for connecting an electromagnetic wave generating unit to a first resonance unit of the electrodeless lamp system in FIG. 1.

In addition, the first and second resonance units 210, 220 can be formed as separate members, and it is also possible to form them as one body by connecting a certain point of the outer circumference of the second resonance unit 220 (center of the second resonance unit 220 in the embodiments of the present invention) as depicted in FIGS. 1 to 3.

In the external conductor 212 of the first resonance unit 210, one side is combined with an outlet 110 of the electromagnetic wave generating unit 100, and the other side is combined with the second resonance unit 220 as a cylinder shape. In addition, in the external conductor 222 of the second resonance unit 220, one side is closed, and the other side has an opening 230 so as to be combined with a reflector 320 of the luminous unit 300 as a cylinder shape.

As depicted in FIG. 1, in the internal conductor 211 of the first resonance unit 210, one side is combined with the outlet 110 of the electromagnetic wave generating unit 100 so as to receive electromagnetic wave, and the other side is extended into the second resonance unit 220 so as to be combined with the internal conductor 221 of the second resonance unit 220.

In the internal conductor 221 of the second resonance unit 220, one side is combined with the closed internal wall of the external conductor 222, the other side is extended toward the luminous unit 300 and is fixedly combined with a fixing member 330 for fixing a bulb unit 310 of the luminous unit 300.

Figure 5:
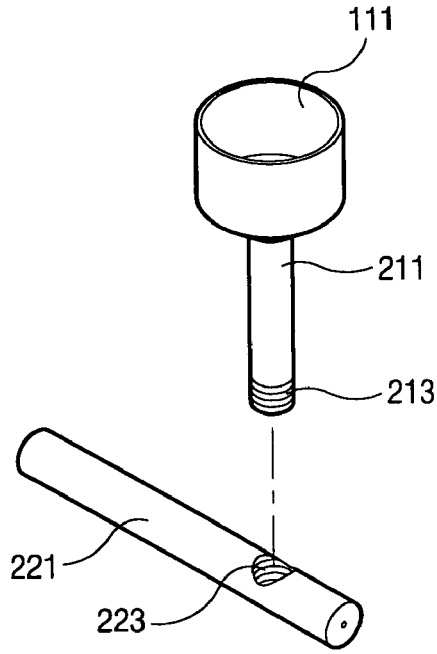
FIG. 5 is a perspective view illustrating a first embodiment of a combination structure among internal conductors of the first resonance unit and a second resonance unit of the electrodeless lamp system in FIG. 1.
Figure 6:
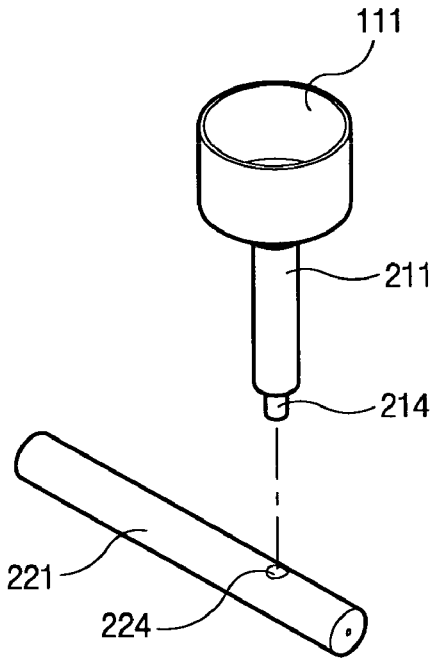
FIG. 6 is a perspective view illustrating a second embodiment of a combination structure among internal conductors of the first resonance unit and the second resonance unit of the electrodeless lamp system in FIG. 1.
Figure 7:
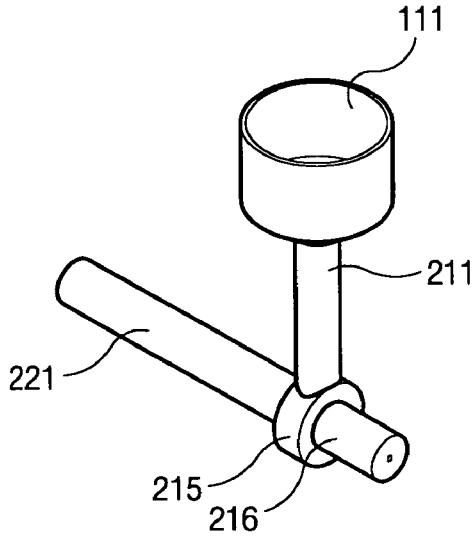
FIG. 7 is a perspective view illustrating a third embodiment of a combination structure among internal conductors of the first resonance unit and a second resonance unit of the electrodeless lamp system in FIG. 1.

As depicted in FIGS. 5 to 7, the internal conductors 211, 221 of the first and second resonance units 210, 220 can have various shapes, in a first embodiment shown in FIG. 5, a screw portion 213 is formed at the internal conductor 211 of the first resonance unit 210, and an internal thread portion 223 is formed at the internal conductor 221 of the second resonance unit 220, and accordingly they can be screw-combined.

In addition, in a second embodiment shown in FIG. 6, the internal conductors 211, 221 of the first and second resonance units 210, 220 can be combined with each other by a pin 214 extended-formed at the end of the internal conductor 211 of the first resonance unit 210 and a pin receiving portion 224 formed on the internal conductor 221 of the second resonance unit 220 so as to receive the pin 214.

In addition, in a third embodiment shown in FIG. 7, the internal conductors 211, 221 of the first and the second resonance units 210, 220 can be combined with each other by forming a combining portion 215 having a through hole 216 at the end of the internal conductor 211 of the first resonance unit 210 so as to receive the internal conductor 221 of the second resonance unit 220. Herein, an outer diameter of the combining portion 215 is greater than that of the internal conductor 221 of the second resonance unit 220, and it can be used for adjusting a matching impedance of the system.

In the meantime, the resonance unit 200 can further include an impedance matching unit 240 for performing impedance matching of the system.

Figure 8A:
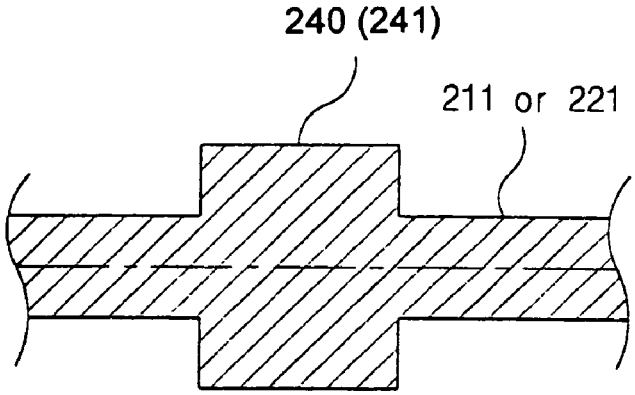
FIG. 8A is a sectional view illustrating a first embodiment of an impedance matching unit of the electrodeless lamp system in FIG. 1.

As depicted in FIG. 8A, the impedance matching unit can be constructed as a stub 241 formed by increasing a sectional area of part of at least one of the internal conductors 211, 221 of the first and second resonance units 210, 220 in the vertical direction.

Figure 8B:
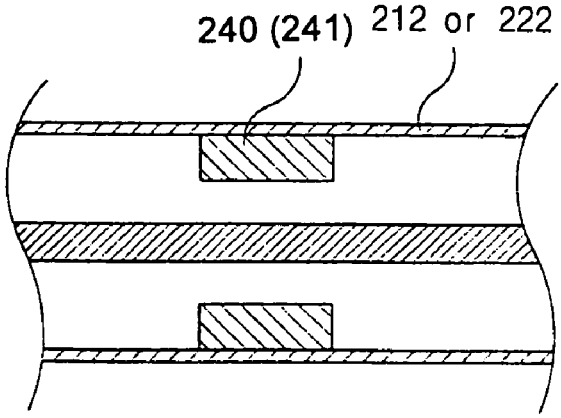
FIG. 8B is a sectional view illustrating the first embodiment of the impedance matching unit of the electrodeless lamp system in FIG. 1.

In addition, as depicted in FIG. 8B, the impedance matching unit 240 can be constructed as a stub 242 formed by projecting part of the internal surface of at least one of the external conductors 212, 222 of the first and second resonance units 210, 220 toward the center, in other words toward inside thereof.

In addition, the stubs 241, 242 can have a cylindrical shape so as to be contacted with part of the inner circumferences of the external conductors 212, 222 of the first and second resonance units 210, 220 in the length direction, the stub 242 formed at or combined with the inner circumference of the external conductor 212 of the first resonance unit 210 can be constructed as at least one block (not shown). In particular, as depicted in FIGS. 1 to 3, it is preferable to form the stub 240 at the connection portion of the first and second resonance units 210, 220 in order to maximize impedance matching effect.

In addition, for minute adjustment, the impedance matching unit 240 can be movably combined with the first resonance unit 210 or the second resonance unit 220 in the length direction, when it is combined with the inner circumference of the external conductors 212, 222, an internal thread portion is formed at the internal circumference cf the external conductors 212, 222, a screw portion is formed at the outer circumference of the stub 240, and accordingly the stub 240 can be movably combined with the external conductor 212, 222 in the length direction.

Figure 14:
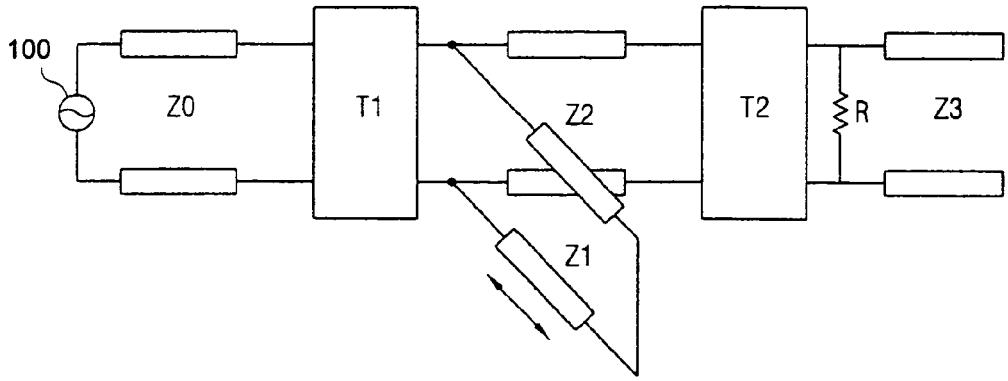
FIG. 14 is a circuit diagram illustrating a construction of an equivalent circuit of the electrodeless lamp system in FIG. 1.

In the meantime, by adjusting design values of the first and second resonance units 210, 220 (inner diameters of the external conductors 212, 222, outer diameters of the internal conductors 211, 221, the stubs 241, 242 and impedance representing internal installations, etc.), resonance and impedance matching can be performed in a certain impedance for generating optimum light flux. Those design values can be obtained by using an equivalent circuit diagram as shown in FIG. 14.

The luminous unit 300 includes the bulb unit 310 filled with luminous material generating light by forming plasma according to electric field.

In general, the bulb unit 310 is made of material having good light transmittance and very low dielectric loss such as quartz, etc. and has a circular or a globular shape. Metal material for leading radiation by forming plasma in the operation, halide, luminous material such as sulfur or selenium, etc., inert gas such as Ar, Xe, Kr, etc. and discharge promoting material such as mercury for facilitating lighting by helping early discharge or adjusting spectrum, etc. of generated light are filled in the bulb unit 310.

The luminous unit 300 further includes the reflector 320 combined with the opening of the second resonance unit 220 and reflecting light generated in the luminous unit 300.

The reflector 320 is combined with the end of the second resonance unit 220, is concave toward the internal surface of the second resonance unit 220, the shape can be variously formed according to usage conditions. Particularly, it can have the curved surface variously so as to make light generated in the bulb unit 310 toward a certain directions. For example, as depicted in FIGS. 1 to 3, it can have a radius of curvature of a parabola which has the bulb unit 310 as a focal point of the parabola in order to make light generated in the bulb unit 310 emit straight. In addition, the reflector 320 is made of dielectric material (dielectric mirror) such as quartz or alumina which is light-reflectable, has a high heat durability, and electromagnetic wave may freely move from the resonance space S to the bulb unit 310 therethrough.

In addition, in the bulb unit 310, the fixing member 330 is formed, and a fixing groove 321 is formed at the center of the reflector 320 so as to receive the fixing member 330, and the fixing member 330 inserted into the fixing groove 321 is combined with the internal conductor 221 of the second resonance unit 220.

Figure 9A:
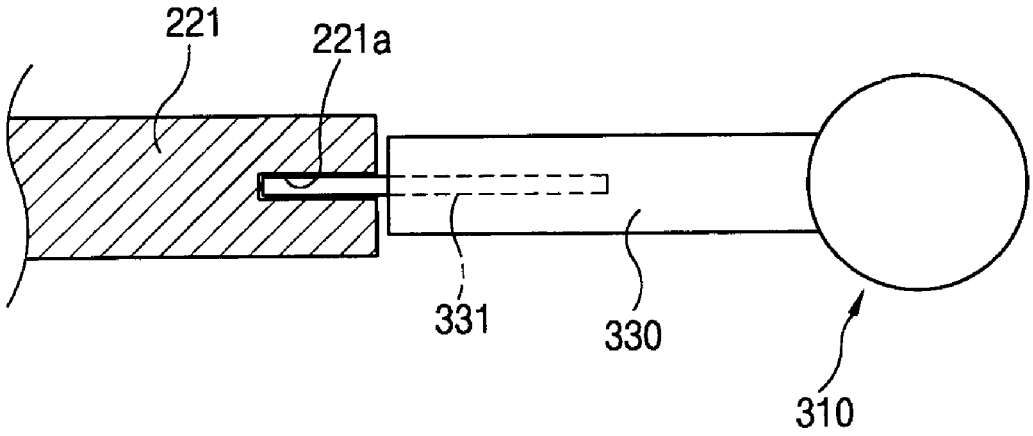
FIG. 9A is a sectional view illustrating a first embodiment of a combination structure of a luminous unit and the first resonance unit of the electrodeless lamp system in FIG. 1.
Figure 9B:
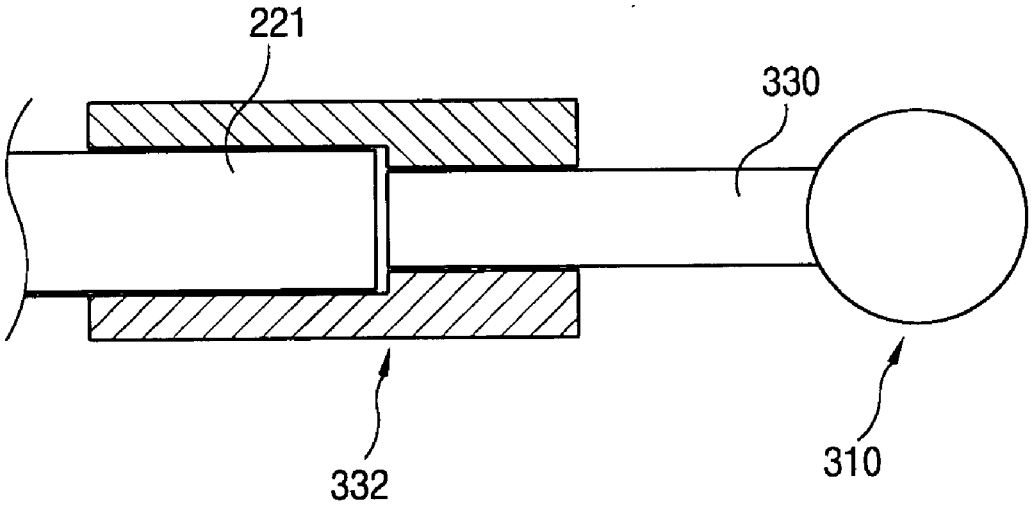
FIG. 9B is a sectional view illustrating a second embodiment of a combination structure of the luminous unit and the first resonance unit of the electrodeless lamp system in FIG. 1.

The fixing member 330 is made of the same material with that of the bulb unit 310. In addition, as depicted in FIG. 9A, the fixing member 330 is connected with the internal conductor 221 by the fixing pin 331 of which ends are respectively inserted into an insertion hole 221*a* formed at the end of the internal conductor 221 of the second resonance unit 220 and into the fixing member 330. Or, as depicted in FIG. 9B, the fixing member 330 is combined with the end of the internal conductor 221 of the second resonance unit 220 by a combining member 332 receiving one end of the fixing member 330 and one end of the internal conductor 221 of the second resonance unit 220.

In the meantime, a size of the bulb unit 310 can be reduced according to usage conditions, and a lighting promoting unit 340 can be further included in order to improve early lighting characteristics.

Figure 10A:
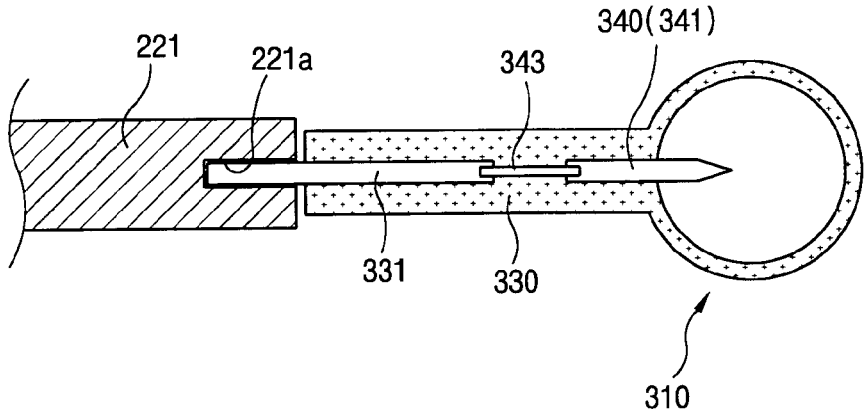
FIG. 10A is a sectional view illustrating a first embodiment of a lighting promoting unit of the electrodeless lamp system in FIG. 1.

As depicted in FIG. 10A, the lighting promoting unit 340 can be constructed as a first conductor 341 fixedly installed at the fixing member 330 of the bulb unit 310 in the axial direction of the second resonance unit 220.

Figure 10B:
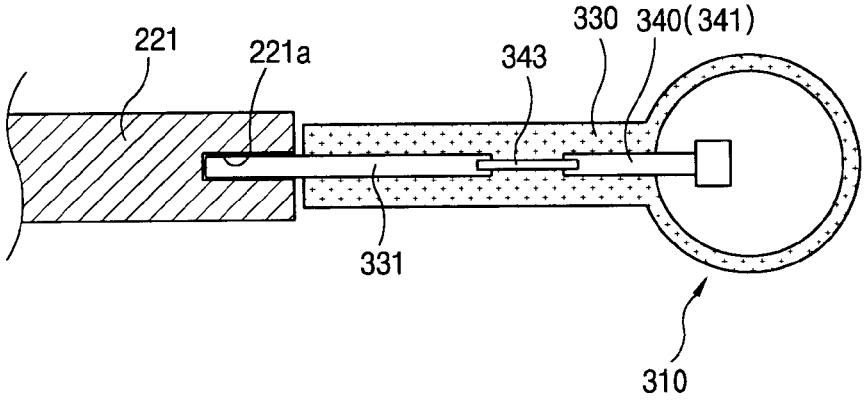
FIG. 10B is a sectional view illustrating a second embodiment of the lighting promoting unit of the electrodeless lamp system in FIG. 1.
Figure 10C:
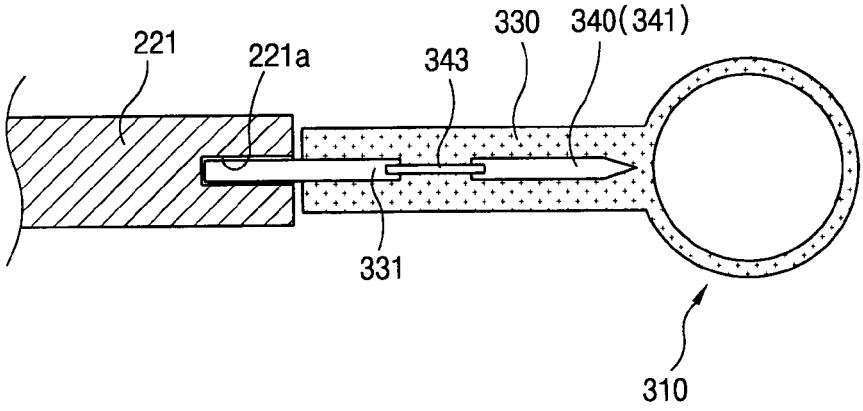
FIG. 10C is a sectional view illustrating a third embodiment of the lighting promoting unit of the electrodeless lamp system in FIG. 1.

As depicted in FIGS. 10A to 10C, part of the first conductor 341 can be internally protruded toward internal space of the bulb unit 310 or be laid inside of the bulb unit 310 and the fixing member 330, the end of the first conductor 341 can be sharp or flat as shown in FIG. 10B. In addition, the first conductor 341 can be connected to the internal conductor 221 of the second resonance unit 220 through a conductive member 343.

Figure 11A:
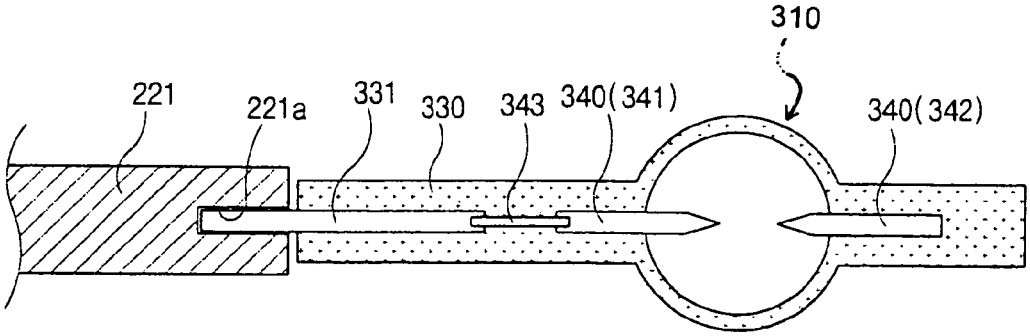
FIG. 11A is a sectional view illustrating a fourth embodiment of the lighting promoting unit of the electrodeless lamp system in FIG. 1.
Figure 11B:
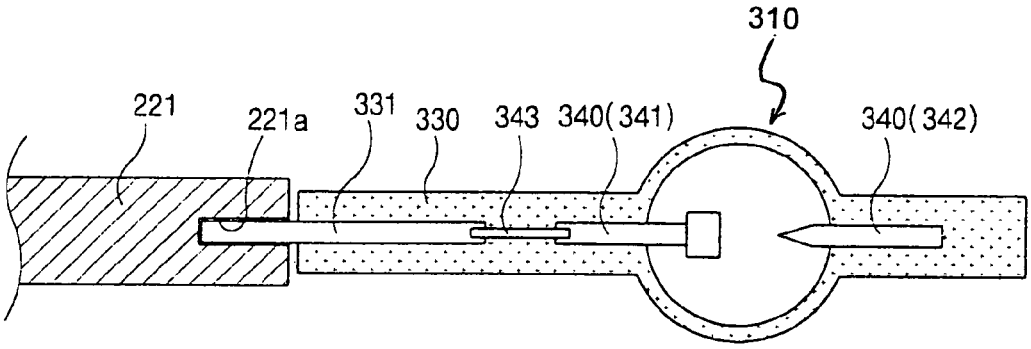
FIG. 11B is a sectional view illustrating a fifth embodiment of the lighting promoting unit of the electrodeless lamp system in FIG. 1.
Figure 11C:
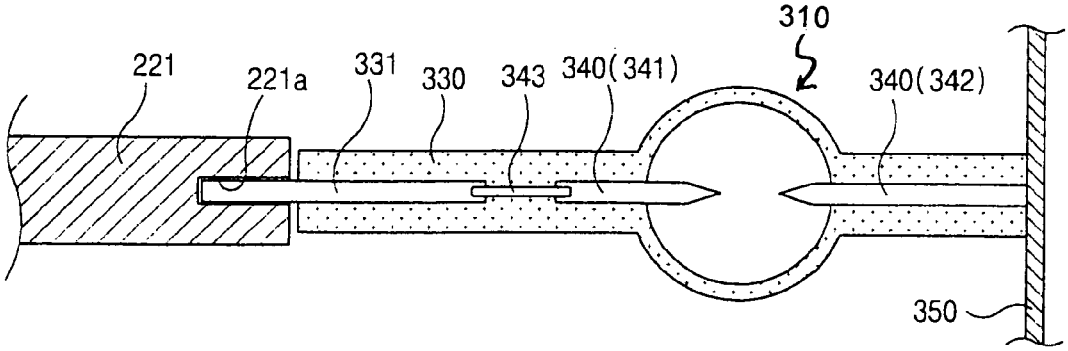
FIG. 11C is a sectional view illustrating a sixth embodiment of the lighting promoting unit of the electrodeless lamp system in FIG. 1.

In addition, as depicted in FIGS. 11A to 11C, the lighting promoting unit 340 can further include a second conductor 342 positioned opposite to the first conductor 341 on the basis of the bulb unit 310. In particular, when both the first and second conductors 341, 342 are sharp, because it is not easy to arrange them centering around the axis of the internal conductor 221 of the second resonance unit 220, as depicted in FIG. 11B, the end of the first conductor 341 is flat, and the end of the second conductor 342 is sharp.

It is preferable to form the second conductor 342 so as to be laid inside of an outer cover of the bulb unit 310, and it can protrude toward the internal space of the bulb unit 310 similar with the first conductor 341.

In addition, as depicted in FIG. 11C, the second conductor 342 can be extended to a inner surface of a cover member 350 and combined with the inner surface of the cover member 350, it is particularly effective when the inner surface of the cover member 350 is mesh-coated with conductive material or is made of mesh itself.

Figure 12:
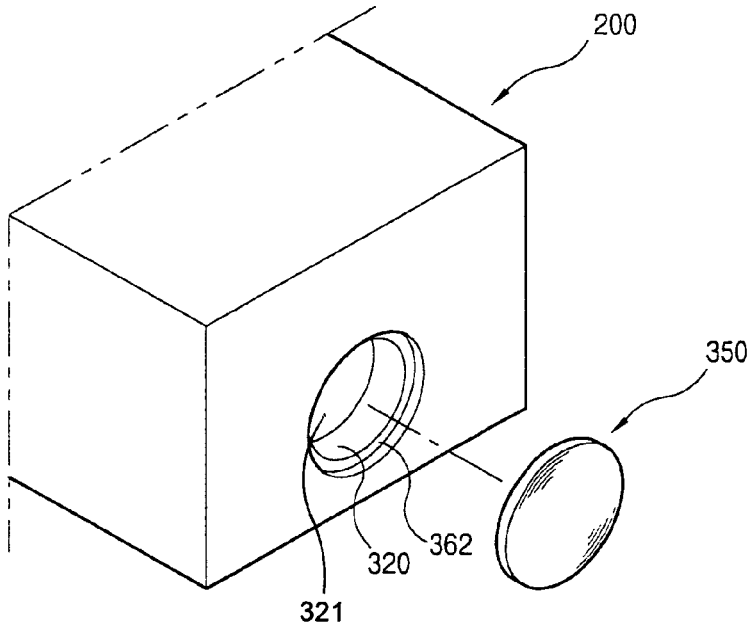
FIG. 12 is a perspective view illustrating a cover unit of the electrodeless lamp system in FIG. 1.

As depicted in FIG. 1, the reflector 320 has the opening 321, as depicted in FIG. 12, the opening 321 further includes the cover member 350 for preventing impurities inflow or improving optical characteristics, etc, or preventing the leakage of the electromagnetic wave.

The cover member 350 is constructed as a filter for improving optical characteristics or a mesh or transparent material mesh-coated with conductive metal material or a transparent conductive film, etc. for preventing electromagnetic wave leakage.

Figure 13:
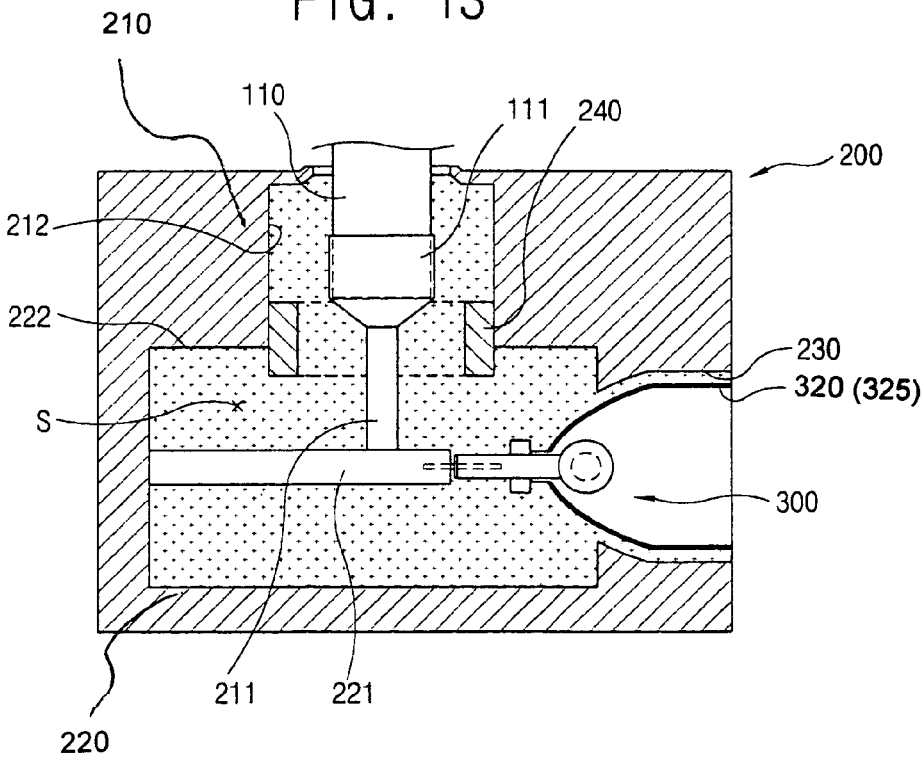
FIG. 13 is a sectional view illustrating dielectric material filled in a resonance space of the electrodeless lamp system in FIG. 1.

In the electrodeless lamp system in accordance with the present invention, to be used as a small light source of a projector, etc., a means for reducing a size is provided, as depicted in FIG. 13, low loss dielectric material such as alumina or TEFLON™, etc. can be filled in the resonance unit 200, namely, the first and second resonance units 210, 220. In that case, it can be operated by the small-sized resonance unit 200. In addition, by constructing the reflector 320 as a reflecting surface 325 reflecting light while passing electromagnetic wave, it is not necessary to install an additional member, the overall structure can be simplified.

In addition, in order to minimize an overall size, as depicted in FIG. 1, a connecting member 111 for reducing the outlet 110 of the electromagnetic wave generating unit 100 can be additionally installed between the electromagnetic wave generating unit 100 and the internal conductor 211 of the first resonance unit 210. In addition, the connecting member 111 can reduce impedance discontinuity between the electromagnetic wave generating unit 100 and the first resonance unit 210.

In the electrodeless lamp system in accordance with the present invention, when an outer diameter of the outlet 110 of the electromagnetic wave generating unit 100 is 'a', an inner diameter of the external conductor 212 of the first resonance unit 210 is 'b', it is preferable to satisfy $1/8<a/b<1/12$.

FIG. 14 shows an equivalent circuit of the electrodeless lamp system in accordance with the present invention. In FIG. 14, Z0 is impedance of the first resonance unit 210, T1 is a parameter about the connection portion (including the stub 240) of the first and second resonance units 210, 220, Z1 is impedance of the second resonance unit 220 from the end of the internal conductor 221 of the second resonance unit 220 to a connecting potion between the internal conductor 211 of the first resonance unit 210 and the internal conductor 221 of the second resonance unit 220, Z2 is impedance from the connection portion between the end of the internal conductor 221 of the second resonance unit 220 and the internal conductor 211 of the first resonance unit 210 to the luminous unit 300, T2 is a parameter about the connection portion between the internal conductor 221 of the second resonance unit 220 and the luminous unit 300, Z3 is impedance of the lighting promoting unit 340, and R is the bulb unit 310.

In the electrodeless lamp system in accordance with the present invention, it is constructed so as to consume all energy in the bulb unit 310 of the luminous unit 300 by adjusting values of the internal construction parts on the basis of a normal operation, it is possible to shield electromagnetic wave leaked to the outside and obtain an optimum efficiency.

The operation of the electrodeless lamp system in accordance with the present invention will be described in detail.

First, by the power apply from the external power source (not shown), the electromagnetic wave generating unit 100 generates electromagnetic wave having a preset frequency, the generated electromagnetic wave are transmitted to the resonance unit 200. The transmitted electromagnetic wave are resonated in the first and second resonance units 210, 220 and are transmitted to the luminous unit 300, the luminous material filled in the bulb unit 310 of the luminous unit 300 is converted into the plasma state by the electric filed formed by the electromagnetic wave, light is generated, and the generated light is proceeded along the shape of the reflector.

Herein, by the lighting promoting unit 340 installed at the bulb unit 310, the bulb unit 310 having a smaller internal space can be lighted in shorter time. In addition, in the first and second resonance units 210, 220, by adjusting appropriately inner and outer diameters of the internal conductors 211, 221 and the external conductors 212, 222, it is possible to have a structure matchable to impedance corresponding to a frequency of the operating electromagnetic wave, and accordingly operational efficiency can be improved.

In addition, in the resonance space S, by installing the stub 240 at the connection portion of the first and second resonance units 210, 220, flow of electromagnetic wave can be smoothed, and accordingly system efficiency can be improved.

In addition, by adjusting a diameter of the outlet 110 of the electromagnetic wave generating unit 110 appropriately, resistance about the internal conductor 211 of the first resonance unit 210 can be reduced, according to that energy transmission is increased, and accordingly it is possible to improve luminous intensity of the lamp and simplify a structure of the stub 240.

In addition, by filling low loss dielectric material such as TEFLON™ or alumina in the resonance space S of the resonance unit 200, because loss of electromagnetic wave can be greatly reduced, efficiency can be improved, and accordingly a size of the electrodeless lamp system can be reduced.

In the resonance unit 200, by installing the internal conductors 211, 221 for guiding electromagnetic wave generated in the electromagnetic wave generating unit 100 into the resonance unit 200 so as to be crossed at right angles, a miniaturized electrodeless lamp system can be obtained.

In addition, by varying a measurement of the first and second resonance units 210, 220, it is possible to adjust a resonance frequency through impedance matching, and accordingly brightness of the electrodeless lamp system can be stabilized. In addition, by reducing a size of the electrodeless lamp system, it is possible to use it for a light source of a projector, etc.

What is claimed is:

1. An electrodeless lamp system, comprising:

an electromagnetic wave generating unit for generating electromagnetic wave;

a resonance unit connected to the electromagnetic wave generating unit for resonating the electromagnetic wave generated in the electromagnetic wave generating unit in a certain frequency; and a luminous unit connected to the resonance unit in order to generate light by forming plasma by an electric field formed in the resonance unit;

wherein the resonance unit includes a first resonance unit and a second resonance unit, the first resonance unit having a first longitudinal axis and being connected to the electromagnetic wave generating unit with the first longitudinal axis parallel to a direction in which the electromagnetic wave is transmitted from the electromagnetic wave generating unit, the second resonance unit having a second longitudinal axis and being connected to the first resonance unit with the second longitudinal axis perpendicular to the first longitudinal axis, the second resonance unit being connected to the luminous unit and forming a resonance space for resonating in the certain frequency with the first resonance unit.

2. The electrodeless lamp system of claim 1, wherein the first and second resonance units respectively include an internal conductor and an external conductor having the same center with that of the internal conductor.

3. The electrodeless lamp system of claim 2, wherein the internal conductors of the first and second resonance units are connected with each other.

4. The electrodeless lamp system of claim 3, wherein the internal conductors of the first and second resonance units are connected with each other by screw-combining.

5. The electrodeless lamp system of claim 3, wherein the internal conductor of the first resonance unit is connected with the internal conductor of the second resonance unit by being inserted into an insertion groove formed at the internal conductor of the second resonance unit.

6. The electrodeless lamp system of claim 3, wherein the internal conductor of the second resonance unit is connected with the internal conductor of the first resonance unit by being inserted into a through hole of a combining portion combined with the end of the internal conductor of the first resonance unit.

7. The electrodeless lamp system of claim 1, wherein the resonance unit further includes an impedance matching unit for performing impedance matching.

8. The electrodeless lamp system of claim 7, wherein the impedance matching unit is installed at a connection portion between the first and second resonance units.

9. The electrodeless lamp system of claim 7, wherein the impedance matching unit is a stub and the stub is combined with the internal circumference of the external conductor of the first resonance unit so as to be movable in a direction of the first longitudinal axis.

10. The electrodeless lamp system of claim 7, wherein the impedance matching unit is a cylinder screw-combined with the internal circumference of the external conductor of the first resonance unit.

11. The electrodeless lamp system of claim 1, wherein dielectric material is filled in the resonance space of the resonance unit.

12. The electrodeless lamp system of claim 1, wherein the second resonance unit is a cylinder on which an opening is formed at one side, and the luminous unit is combined with the opening.

13. The electrodeless lamp system of claim 1, wherein the luminous unit includes: a bulb unit filled with luminous material for generating light by forming plasma excited by the electric field.

14. The electrodeless lamp system of claim 13, wherein the luminous unit further includes:

a reflector combined with the second resonance unit in order to reflect light generated in the luminous unit.

15. The electrodeless lamp system of claim 14, wherein the reflector further includes a cover member for covering an opening of the reflector.

16. The electrodeless lamp system of claim 15, wherein the cover member is a transparent material transmitting light, and the internal surface or external surface thereof is mesh-coated in order to prevent electromagnetic wave leakage.

17. The electrodeless lamp system of claim 15, wherein the cover member is a filter member for improving optical characteristics.

18. The electrodeless lamp system of claim 15, wherein the cover member is a mesh for preventing electromagnetic wave leakage from the second resonance unit.

19. The electrodeless lamp system of claim 2, wherein the first and second resonance units include the respective an external conductor having the same center with that of the corresponding internal conductor.

20. The electrodeless lamp system of claim 19, wherein the bulb unit further includes a lighting promoting unit for activating early lighting.

21. The electrodeless lamp system of claim 20, wherein the lighting promoting unit is a first conductor fixedly installed at a fixing member of the bulb unit in a direction of the second longitudinal axis.

22. The electrodeless lamp system of claim 21, wherein the first conductor is laid in the fixing member.

23. The electrodeless lamp system of claim 21, wherein part of the first conductor is projected toward an internal space of the bulb unit.

24. The electrodeless lamp system of claim 21, wherein the first conductor has a sharp end.

25. The electrodeless lamp system of claim 21, wherein the first conductor is connected with the internal conductor of the second resonance unit through a conductive member.

26. The electrodeless lamp system of claim 21, wherein the lighting promoting unit further includes a second conductor installed so as to be opposed to the first conductor of the bulb unit.

27. The electrodeless lamp system of claim 26, wherein the second conductor is connected with a cover member covering the reflector through a conductive member.

28. The electrodeless lamp system of claim 26, wherein the second conductor is laid in an outer cover of the bulb unit.

29. The electrodeless lamp system of claim 26, wherein the first conductor has a flat end, and the second conductor has a sharp end.

30. The electrodeless lamp system of claim 20, wherein the lighting promoting unit further includes a second conductor installed so as to be opposed to the second resonance unit of the bulb unit.

31. The electrodeless lamp system of claim 1, further comprising:

a connection member for reducing discontinuity of impedance between the electromagnetic wave generating unit and the first resonance unit.

32. The electrodeless lamp system of claim 1, wherein the electrodeless lamp system satisfies $1/8 < a/b < 1/12$ when an outer diameter of the outlet of the electromagnetic wave generating unit is a, an inner diameter of the external conductor of the first resonance unit is b.

* * * * *